United States Patent [19]

Noble et al.

[11] 3,974,963

[45] Aug. 17, 1976

[54] RAILWAY WHEEL SQUEAL SUPPRESSION ARRANGEMENT

[75] Inventors: Peter M. Noble, Valencia; Philip J. Delvernois, Jr., Monroeville, both of Pa.

[73] Assignee: Westinghouse Air Brake Company, Swissvale, Pa.

[22] Filed: Nov. 15, 1974

[21] Appl. No.: 523,979

[52] U.S. Cl. ..... 238/382; 104/1 R; 104/26 R

[51] Int. Cl.[2] ..... E01B 19/00

[58] Field of Search ..... 238/283, 284, 302, 382; 104/26 R, 26 A, 1 R; 246/182 A, 246, 251, 169 S; 188/62; 181/33 A

[56] References Cited

UNITED STATES PATENTS

| | | | |
|---|---|---|---|
| 1,818,970 | 8/1931 | Clausen | 246/246 |
| 2,408,553 | 10/1946 | Gieskieng et al. | 246/246 X |
| 2,452,480 | 10/1948 | Mason | 246/246 |
| 2,715,369 | 8/1955 | Doehler | 104/26 A |
| 3,609,350 | 9/1971 | Wilson et al. | 104/26 A X |
| 3,716,114 | 2/1973 | Beck | 238/382 X |

*Primary Examiner*—L. J. Paperner
*Assistant Examiner*—Randolph A. Reese
*Attorney, Agent, or Firm*—J. B. Sotak; R. W. McIntire, Jr.

[57] ABSTRACT

This disclosure relates to a railway trackway having a pair of running rails and including a plurality of vibrational dampening mechanisms disposed at selected intervals along the running rails of the trackway. Each of the vibrational dampening mechanisms includes a support assembly and a biased wheel engaging assembly for engaging the passing wheels of the railway vehicles for dissipating the vibrational energy imparted to the vehicle wheels thereby preventing the production of wheel squealing or screeching noises.

9 Claims, 4 Drawing Figures

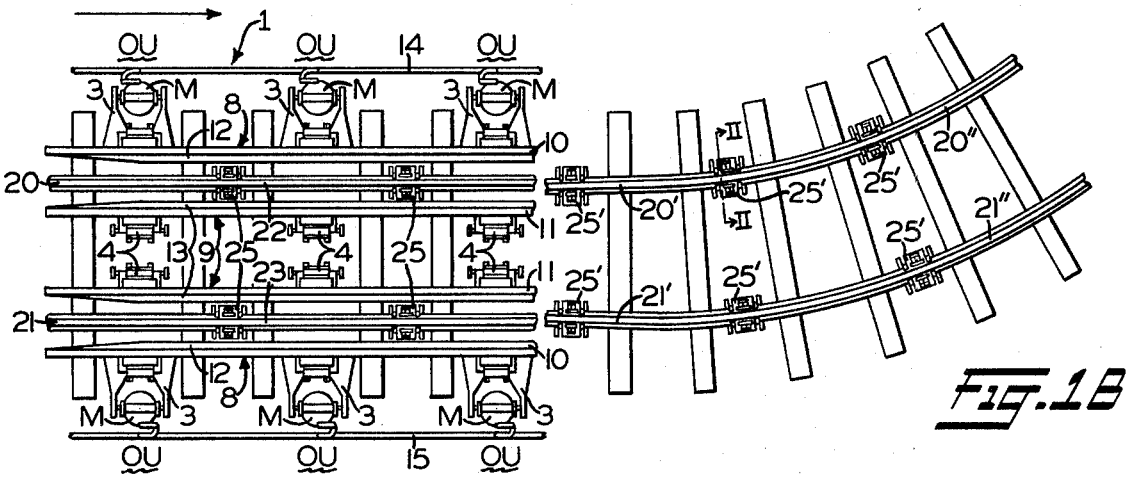
FIG. 1A
FIG. 1B
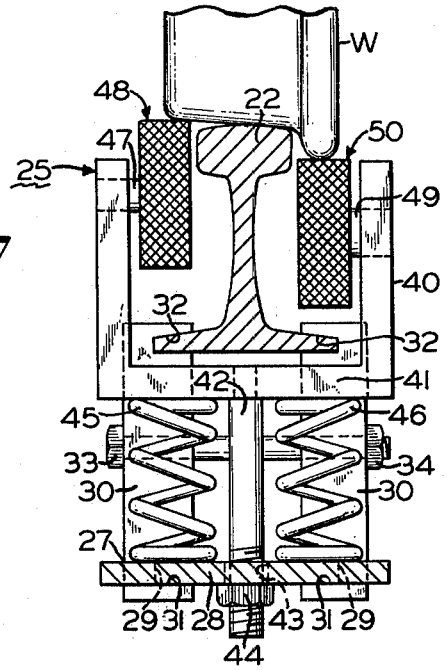
FIG. 2
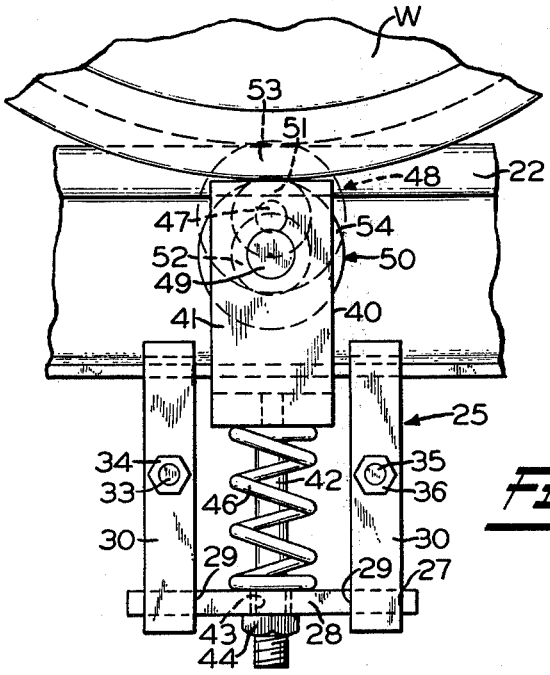
FIG. 3

RAILWAY WHEEL SQUEAL SUPPRESSION ARRANGEMENT

SUBJECT OF THE INVENTION

This invention relates to a novel noise suppression arrangement for railway vehicles moving along the trackway and more particularly to a plurality of vibrational dampening mechanisms carried by the running rails for removing vibrational energy from the wheels of passing railway vehicles for preventing the production of wheel squealilng or screeching sounds.

BACKGROUND OF THE INVENTION

In a gravity type of railroad marshalling or classification yard, it is conventional practice to employ grip or squeeze types of car retarders at both master and group locations to control the leaving speeds of humped railway cars or vehicles. Additionally, it is also becoming increasingly common to employ a car retarder at the exit end of each of the class tracks in the yard to stop the oncoming railway cars as they are processed into the respective classification tracks. The car retarders frictionally engage or grip the opposite sides of the car wheels to slow down the moving railway cars as they pass through the master and group locations and to arrest the railway vehicles in the class tracks. On numerous occasions, the frictional gripping action between the brake shoes and wheel results in extremely loud and piercing squealing noises to permeate the immediate area surrounding or bordering the classification yard. These high pitched screeching sounds not only are irritating or annoying to the people in the surrounding area but also are painful and injurious to working personnel in the classification yard. In some cases, a partial or total loss of hearing may result when employees are exposed to the retarder noises for extended periods of time. It has been found that long-term exposure to sounds above a given critical level adversely affects workmen or supervisory personnel who work in the area of the car retarders. These acute and detrimental sound waves are produced by the stick-slip or rubbing action which takes place between the sides of the wheels of the moving car and the engaging surfaces of the brake shoes of the actuated car retarder. In actual operation, it has been found that the most troublesome pitch or frequency range of the retarder generated sound waves lies between 2,000 to 4,000 hertz. Further, the loudness or amplitude level of the noises may reach 130 decibels (db) or on the H scale more at a distance of 8 feet or less from the car retarder. Otolarynologists, audiologists and other qualified specialists have found that human beings experience discomfort and pain when exposed to noise level of 120 db or more and that repeated exposure to such high levels of noise can eventually result in hearing losses. Recently there have been numerous proposals and attempts to eliminate or at least reduce the noise level in order to comply with the regulations of the Occupational Safety and Hazard Act and the noise pollution ordinances of the given locale. However, each of these previous attempts was either prohibitively expensive or mechanically unsound and, therefore, did not meet with industry-wide acceptance. The proposition of replacing steel brake shoes with ductile iron appeared plausible but proved uneconomical since ductile iron shoes wear four times as fast as steel. Hence, a railroad car retarder equipped with ductile iron shoes normally requires four times as many shoe replacements as an all-steel retarder. Obviously, a car retarder fitted with ductile iron shoes needs a greater number of adjustments and requires more periods of maintenance than a car retarder equipped with steel shoes. The use of lubricants, such as, oils and mixtures of other unctuous liquids, that are sprayed or otherwise applied to the contacting surfaces of the brake shoes and wheels for eliminating wheel squealing or screeching noises is also possessed of several shortcomings. The utilization of lubricants not only materially decreases the effective braking length of the car retarder but also dramatically increases the initial purchase price as well as the subsequent maintenance cost of the overall car retarder. A further deleterious effect of employing lubricants in combating the noise pollution problem is the unctuous ground covering in the immediate area of the car retarder as well as the oil dropping pollution caused throughout the classification yard. A further method in attempting to resolve the noise pollution problem in classification yards has been the erection of sound barriers or walls on the respective sides of the railroad car retarder. In previous types of noise barriers, the use of porous noise absorption material was unacceptable in that they soon become relatively ineffective in suppressing the noise produced by the car retarder. The principal reason for the loss in sound attenuation resides in the fact that the porous material readily becomes clogged with foreign matter, such as, dirt, oil, grease, water, ice and the like, which is common in a classification yard environment. In addition, low density types of noise absorption materials are generally susceptible to rapid deterioration due to the adverse physical and climatic conditions which are present in railroad yard milieu. Further, it will be appreciated that the maximum theoretical value of noise reduction or attenuation provided by a barrier structure is approximately 25 db which in many cases is insufficient to conform with the noise abatement ordinances in the particular locale and the safety standards set forth in the Occupational Safety Hazard Act of 1970. In present classification yards and in future proposed yard locations, it has been found that even at substantial distances, 5,000 feet or more, the noise level that permeates the area beyond the boundary line of the yard is in excess of the maximum permissible amplitude set forth in many of the local noise abatement ordinances. Thus, there is a vital need for providing an efficient noise reduction arrangement for effectively reducing or eliminating wheel squealing or screeching sounds produced by railroad car retarders. In addition, there are numerous other places or locations in railroad or steel-wheel-on-steel-rail mass and/or rapid transit operations where wheel squealing noises are produced by the interaction of the wheels of the moving vehicles and the running rails. For example, when vehicles traverse curved track sections, the wheels have a tendency to become skewed so that binding and abrading action occurs which results in the generation of squealing sounds. Likewise, there are sections of track that have tight gage portions which cause the production of wheel squealing noises. That is, when the distance between the two rails of the track become less than the normal or standard gage the inside surface portions of the rails seize the flanges of the vehicle wheels so the vibrational forces are imparted to the wheels which result in wheel screeching noises. These wheel squealing sounds are somewhat irritating to operating personnel and passengers onboard the vehicles and are offensive to wayside commuters as well as to the workers and inhabitants in the immediate area of the trackway. Thus, like in classification or marshalling yards, there are municipal ordinance and governmental requirements which make it incumbent upon the railroad companies and mass and/or rapid transit authorities to suppress and eliminate noise pollution in the operation of their systems.

OBJECTS AND SUMMARY OF THE INVENTION

Accordingly, it is an object of this invention to provide a new and improved vibrational energy dissipating arrangement for suppressing wheel squealing noises.

Another object of this invention is to provide a unique noise reduction arrangement for a railroad operation by disposing a series of vibrational dampening mechanisms along the running rails for dissipating sound producing energy imparted to the wheels of railway vehicles.

A further object of this invention is to provide a unique vibrational dampening arrangement employing a plurality of resiliently biased mechanisms for contacting the wheels of railway vehicles as they pass the trackway.

Yet another object of this invention is to provide a novel noise suppressing arrangement utilizing a plurality of vibration absorbing mechanisms disposed along the length of a trackway.

Yet a further object of this invention is to provide an anti-noise arrangement for either railroad car retarders, curved or tight gage track sections employing a depressible carrier and support assemblies for removing vibrational energy from the wheels of passing railway vehicles.

Still another object of this invention is to provide a series of wheel dampening mechanisms located at selected points along the length of a railway car retarder to dampen the sound producing vibrations imparted to the wheels of traversing railway cars.

An additional object of this invention is to provide in combination, a railroad car retarder having a plurality of operating units disposed along the length of a running rail of a trackway, an elongated braking bar disposed on each side of the running rail and carried by the plurality of operating units, the elongated braking bar including a brake beam and a brake shoe for engaging the wheels of railway vehicles, characterized by a plurality of vibrational dampening mechanisms disposed at selected points along the running rail for contacting the vehicle wheels for removing vibrational energy from the wheels for preventing the production of wheel screeching sounds.

Still an additional object of this invention is to provide in combination a section of track having a pair of running rails for supporting and guiding the wheels of moving railway vehicles, characterized by a plurality of vibrational dampening mechanisms each of which includes a support assemblage securely attached to the running rail and includes a biased wheel engaging assemblage for removing vibrational energy from the passing wheels of the vehicles moving along the running rails.

Yet an additional object of this invention is to provide a novel vibrational dampening arrangement for car retarders which is economical in cost, simple in construction, easy to install and reliable in operation.

In the attainment of the foregoing objects there is a trackway having a pair of running rails for guiding and supporting moving vehicles. In one application a gripping type of railroad car retarder having a plurality of operating units is located along the length of the running rails of sections of track in a classification yard. Each of the operating units includes a fluid pressure motor and a pair of pivotal levers. Each of the pivotal levers carries an elongated braking bar which includes a brake beam and brake shoe movable to a braking position for engaging the sides of the wheels of railway vehicles traversing the car retarder. The running rail which extends substantially along the length of the car retarder is provided with a plurality of vibrational dampening mechanism located at selected points along its length. In another application, the vibrational dampening mechanisms are located along a curved track section or a tight gage section of the trackway. Each of the vibrational dampening mechanisms includes a support assemblage and a biased wheel engaging assemblage. The support assemblage includes a base plate and a plurality of upright bracket members which securely grip the flange portions of the running rail. The biased wheel engaging assemblage includes a U-shaped depressible carrier member which is guided by a treaded rod and is urged upwardly by a pair of compression springs. Each of the free ends of the U-shaped carrier member is provided with a rotatable wheel having an inner metallic hub and an outer elastic tire. The elastic tires of the rotatable wheels are adapted to engage the flanges and running tread of the passing wheels of the vehicles for removing vibrational energy imparted to the wheels by the stick slip action of the brake shoes, by the abrading-holding action on curved track sections or the gripping-binding action on tight gage track sections so as to prevent the development of wheel squealing or screeching noises.

Other ojbects, features and advantages of this invention will become more apparent from the following description of the preferred embodiments described with reference to the accompanying drawings forming a part of this specification, in which:

FIG. 1A is a fragmentary top plan view of a track section in, for example, a hump type of railroad freight car classification yard, utilizing a squeeze or gripping type of car retarder for controlling the speeds of moving railway vehicles and including a plurality of vibrational dampening mechanisms selectively located along the length of the running rail for reducing the production of wheel squealing noises.

FIG. 1B is a fragmentary top plan view of a curved track section and a tight gage track section either of which may be situated along the trackway of a railroad and mass and/or rapid transit system.

FIG. 2 is an enlarged sectional view taken along the lines II—II of FIG. 1B.

FIG. 3 is a side elevational view partly in phantom of a fragmentary one of the plurality of vibrational dampening mechanisms which may be utilized in the track sections of FIGS. 1A and 1B.

Referring now to the drawings and in particular to FIG. 1B there is shown a railroad car retarder generally characterized by numeral 1. In hump or gravity types of classification yards, it is desirable to sort and classify the freight cars or vehicles of an incoming train into other trains in accordance with their contents and/or their next destination. The railway cars of the incoming trains are pushed over a hump or incline so that the force of gravity moves the cars to the appropriate location in the selected one of the plurality of class tracks. However, various parameters, such as, car weight, rolling resistance, wind velocity and the like, cause each of the free rolling cars to travel down the trackway at a different speed. In order to control the speed of the moving cars in accordance with their rollability and the distance-to-go, it is common practice to provide suitable braking apparatus at the hump and group track locations in the classification yard. Generally, the braking apparatus takes the form of the squeeze or gripping type of car retarder which has braking bars that are movable into and out of engagement with the wheels of passing railway cars for controlling the speed thereof. In group and hump applications, it is common practice to employ a dual track car retarder in order to ensure that sufficient braking effort is exerted on the wheels of the cars as they pass through the retarder.

As shown in FIG. 1B, the dual track car retarder 1 includes a plurality of suitable operating units OU appropriately disposed along each running rail of a section of trackway. As is well known, each of the operating units is substantially identical, and a typical operating unit OU consists of an upper lever 3 and a lower lever 4. The levers 3 and 4 are operated by a fluid actuated motor M which causes pivotal movement about the common fulcrum point or pin located under the respective running rail. It will be seen that the free end of the upper pivotal lever 3 is also pivotally connected to the pneumatic cylinder member (not characterized) of motor M while the free end of the lower pivotal lever 4 is also pivotally connected to the reciprocal piston member of motor M. It will be noted that the upper lever 3 carries an elongated outer braking bar 8 while the lower lever 4 carries an elongated inner braking bar 9. As shown in FIG. 1B the braking bars 8 and 9 extend parallel to the track rails and are adapted to be moved relative to the track rails into braking and nonbraking positions. The braking bars 8 include brake beams 10 which are bolted to the upper surface of levers 3 while the braking bars 9 include brake beams 11 which are bolted to the upper surface levers 4. The braking bars 8 include the elongated outer replaceable brake shoes 12 which are bolted to the brake beams 10, and the braking bars 9 include the elongated inner replaceable brake shoes 13 which are bolted to the brake beams 9. Thus, the pivotal movement of the levers 3 and 4 about the common fulcrum point causes the braking bars 8 and 9 to move toward and away from each other as the fluid motors M are energized and deenergized via conduits 14 and 15 which are connected to a suitable source of fluid pressure (not shown). Hence, upon application of fluid pressure via conduits 14 and 15 to fluid actuating motors M, the braking bars 8 and 9 undergo an elevating and closing movement so that the brake shoes 12 and 13 frictionally engage the sides of wheels of the traversing railway vehicles. Conversely, upon the venting of the air from the actuating motors M to atmosphere via conduits 14 and 15, the force of gravity with the assistance of return springs (not shown) operating on levers 3 and 4 acts to lower and open the braking bars 8 and 9 to their normal nonbraking position. Accordingly, when a railway car or cut of cars moves through the retarder, the closing and opening of the braking bars allows for the speed of the traversing car or cars to be controlled in accordance with its ultimate destination in a class track.

A common occurrence in conventional squeeze or grip types of railroad car retarders is the production or development of large amplitude vibrations in the vehicle wheels and braking bars when the retarder remains closed for a given period of time. These vibrations imparted to the wheels build up and result in a very loud high pitched squealing or screeching noise to be produced by the retarder. That is, the stick-slip mechanism or the rubbing-grating action which takes place between the surfaces of the brake shoes and the sides of the vehicle wheels produces sufficient sound generating energy over a period of time to cause the wheels to squeal. Thus, the sound producing energy should be prevented from building up to the point where the retarder is capable of developing wheel screeching sounds. In order to abate this noise problem, it has been found to be desirous and advantageous to reduce or dampen out the sound producing energy by employing a vibration absorbing arrangement in combination with the railroad car retarder 1. It will be appreciated that the entrance rail sections 20 and 21, namely, the left-hand rails as viewed in FIG. 1B of the drawings, are standard steel rails, such as, 90 lb. rails. As shown, the rails 20 and 21 are fastened to the ends of running rails 22 and 23, respectively, in the usual manner by means of rail joints (not characterized). The running rails 22 and 23 extend substantially the length of the car retarder 1, and the ends are in abutting relationship with the ends of exit rails (not shown). As is conventional, the running rails 22 and 23 are also securely fastened to exit rails by means of suitable rail joints (not shown).

As previously mentioned, if the car retarder 1 remains closed for a given period of time when a railway vehicle is moving through it, the brake shoes will cause the wheels to begin to vibrate due to the slip-slide braking action. In previous retarder operations, this inpetuous force or imparted vibrational energy to the wheels resulted in the generation of very high pitched squealing or screeching noises. In the present instance, the wheel squealing noises are circumvented by employing a vibrational energy dampening or absorbing arrangement in combination with the car retarder 1. As shown, the novel noise suppressing arrangement includes a plurality or a series of vibrational dampening mechanisms 25 suitably located at select points along the length of both of the running rails 22 and 23. In viewing FIGS. 2 and 3, it will be observed that each of the dampening mechanisms 25 includes a lower fixed support assembly 27 securely attached to the running rail 22. The support assemblage 27 includes a steel base plate 28 centrally located beneath the running rails. The base plate 28 includes four rectangular slots 29 located on its sides near the respective corners. The support assemblage 27 includes a plurality of four upright steel bracket members 30 which cooperate with the base plate 28 and the flange portion of the running rail 22. As shown in FIGS. 2 and 3, each bracket member 30 includes a rectangular cutout or slot 31 at the lower extremity which interlocks with the slots 29 of the base plate 28. Further, as shown in FIG. 2, the upper end of each of the bracket members 30 includes a cutout or slot 32 which fits onto and grips the outer edges of the flange portion of the running rail 22. It will be observed that the two bracket members opposite each other are rigidly held together by tie bolts and nuts. That is, the first pair or left-hand bracket members 30 are tied together by bolt 33 and nut 34 while the second pair or right-hand bracket members 30 are tied together by bolt 35 and nut 36. The vibrational dampening mechanism 25 also includes an upper biased wheel engaging assemblage 40 including a vertically movable carrier member 41 which takes the form of a U-shaped channel member. The horizontal flat bottom portion of the U-shaped channel member 41 is disposed parallel to the base plate 28. A guide rod or bolt 42 has one end securely fixed such as by being staked or welded to the center of the flat bottom portion of member 41. The depending guide rod 42 is aligned with the aperture or hole 43 located in the center of base plate 38. The free end of the rod 42 is threaded so that nut 44 is screwed thereon. A pair of preloaded compression springs 45 and 46 are located on either side of guide rod 42. The dual springs are disposed between the plate 38 and the flat bottom portion to provide a stable arrangement whereby the guide rod 42 allows free vertical movement of the carrier assemblage 40. In view of FIG. 2, it will be noted that on the upper free end of the left leg of the channel member 41 there is provided an inwardly extending pivot shaft 47 upon which is journaled a rotary wheel 48. Similarly, the upper end of the right leg of the channel member 41 is provided with an inwardly extending pivot shaft 49 upon which is journaled a rotary wheel 45. In operation, the wheel engaging assemblage 40 is initially adjusted by appropriately turning the nut 44 either to raise or lower the movable carrier 41 to the point when the tread and flange of the passing wheel W engage the elastic wheels 48 and 50 respectively and depress the movable wheel engaging assemblage 40. After the wheel W passes, the biasing springs 45 and 46 will urge and return the carrier 41 and elastic wheels 48 and 50 to their upper wheel engaging position. In practice, the wheels 48 and 50 include metallic inner hub portions 51 and 52, respectively, upon which is mounted an elastic tire or outer tread portions 53 and 54, respectively. The tire portions 53 and 54 are constructed of suitable resilient material such as rubber or urethane or some other suitable elastic substance. In a classification application, it will be appreciated that as the humped vehicle enters the car retarder, the slip-slide action between the wheels W and brake shoes 12 and 13 causes vibrational energy to begin to build up in the wheels traversing the running rails. However, before the amplitude of the vibrational forces is sufficient to cause wheel squealing noises, the flanges and treads of the wheels of the vehicle will contact the resilient wheels 50 and 48, respectively. The rubber or urethane tires provide an energy dampening or absorbing effect on the passing wheels so that the vibrational forces are removed and dissipated by the mechanism friction and viscosity of the elastomer tire and wheel engaging assemblage. Thus, energy is removed from the wheels of the passing cars by the first set of vibrational dampening assemblages 25 located at the entrance end of the retarder 1. It will be appreciated that the engagement of the car wheel flanges and treads with the tires 48 and 50 causes the contacted wheels to rotate so that the amount of abrasive frictional wear is minimized. It will be noted that the diameter of the wheels or tires 48 and 50 will determine the length of arcuate contact between the treads and flanges and periphery of the elastic tires, in turn, the amount of angular rotation of the wheels 48 and 50. Thus, the vibration dampening or absorbing effect continues through the arcuate contact of the treads and flanges with the elastic tires. As the vehicle wheels W disengage the resilient tires 48 and 50, vibrational energy is again imparted to the wheels W due to their mechanical engagement with the running rails and the closed brake shoes 12 and 13. It will be appreciated that the distance between the first pair of vibrational dampening mechanisms 25 and the second pair of vibrational dampening assemblages 25 is chosen to be less than that required to have the vibrational force built up to the point where wheel squealing will occur. Thus, the vehicle wheels will contact the periphery of the rubber tires of the second pair of vibrational dampening assemblage before any wheel screeching noises occur so that the impressed vibrational forces are again absorbed and dissipated by the dampening action of the second pair of vibrational dampening mechanisms. Similarly, when the passing wheels disengage the tires of the second dampening mechanisms 25, vibrational energy is again imparted to the wheels W but the wheels will engage the third pair of vibrational dampening mechanisms 25 before the build up is capable of causing the production of wheel squealing noises. The energy build up and vibrational dampening is repeated as the wheels pass from the third pair of vibrational dampening mechanisms to the fourth pair of dampening mechanism, etc., until the wheels emerge from the car retarder and exit onto the stock rails leading to the class tracks. That is, the vibrational forces assimilated by the vehicle wheels are repeatedly dampened and dissipated by the series of vibrational dampening mechanism 25 located along the length of the car retarder 1 so that wheel screeching sounds are prevented from being produced by the slip-slide action which takes place between the sides of the car wheels W and the surfaces of the brake shoes 12 and 13. Accordingly, the plurality of vibrational dampening mechanisms 25 efficiently and effectively prevent the production of irritating and injurious wheel squealing noises which would normally be generated by car retarders in railroad classification yards.

As previously mentioned, there are other locations in a railroad and mass and/or rapid transit operation where wheel squealing noises are generated by the interaction of the car wheels and the steel running rails. For example, on curved track sections such as represented by rails 20'' and 21'' as shown in FIG. 1B the wheels of the moving vehicles become skewed as they negotiate the bends or turns of the trackway. The skewed wheels tend to slide and chafe against the rail surfaces so that wherel squealing or or screeching noises are produced as the wheels traverse the curved track sections. Similarly, wheel screeching or squealing sounds are generated as the vehicles traverse tight gage track sections as shown by rails 20' and 21' in FIG. 1B. When the distance between the running rails of the track is less than the normal or standard gage of 4 feet 6 ½ inches, the wheels bind against the surfaces of the rails and cause wheel screeching noises. Thus, it is advisable to place a series of vibrational dampening mechanisms 25' along the tight gage track rails 20' and 21' and on curved track rails 20'' and 21'' as shown in FIG. 1B.

It will be appreciated that various changes, alterations and modifications may be made in the construction of the presently described arrangement without departing from the spirit an scope of the subject invention. For example, the size of the wheels and tires may be increased or decreased to vary the contact time between the treads and flanges of the vehicle wheels W and the elastic wheels 48 and 50 to remove a more or a less amount of vibrational energy from the vehicle wheels. Similarly, the distance between adjacent pairs of the vibrational dampening assemblages 25 and 25' may be changed if a lesser amount of time is required to cause wheel squealing noises or if a greater amount of time is possible before the occurrence of wheel screeching sounds. It is understood that the rubber tires 53 and 54 may be replaced by other suitable elastic material or vibrational dampening material. In addition, the vibrational dampening mechanisms may be arranged in staggered relationship and the number of vibrational dampening mechanisms per retarder may be varied in accordance with the particular need of each specific installation. Therefore, it is intended that the subject matter contained in the foregoing description and shown in the accompanying drawings should be interpreted as illustrative and not in a limiting sense.

Having now described the invention, what we claim as new and desire to secure by Letters Patent, is:

1. In combination, a section of railway track having a pair of running rails for supporting and guiding the wheels of moving railway vehicles, characterized by a plurality of vibrational dampening means positioned at selected points along the running rails for preventing the generation of wheel squealing noises, each of said vibrational dampening means including a support assemblage securely attached to the running rails, each of said vibrational dampening means including a biased wheel engaging means for removing vibrational energy from the passing wheels of the vehicles moving along the running rails and each of said vibrational dampening means including a movable carrier member having at least one rotary device for contacting the passing wheels of the railway vehicle.

2. The combination as defined in claim 1, wherein said vibrational dampening means includes a pair of compression springs for upwardly biasing said wheel engaging means.

3. The combination as defined in claim 1, wherein said support assemblage includes a base plate and a plurality of upright bracket members which grip the flanges of the running rails.

4. The combination as defined in claim 1, wherein said rotary device is a wheel having an elastic tread which engages the passing wheels of the vehicles.

5. The combination as defined in claim 1, wherein said biased wheel engaging means includes a depressible carrier member upon which is mounted a pair of rotatable wheels which engage the wheels of the passing vehicles.

6. The combination as defined in claim 5, wherein said depressible carrier member includes a rod for guiding and retaining said depressible carrier member in relation to said support assemblage.

7. The combination as defined in claim 5, wherein said rod is threaded to permit vertical adjustment of said depressible carrier member to compensate for wear of said rotatable wheels.

8. The combination as defined in claim 5, wherein said depressible carrier member is a U-shaped channel member.

9. The combination as defined in claim 8, wherein said rotatable wheels are pivotally mounted to the free ends of said U-shaped channel member.

* * * * *